US010932529B2

(12) United States Patent
Mulfeld

(10) Patent No.: US 10,932,529 B2
(45) Date of Patent: Mar. 2, 2021

(54) BUCKLE FOR USE WITH A BELT, STRAP OR OTHER SECUREMENT MEMBER

(71) Applicant: Stanley Mulfeld, Sunnyside, NY (US)

(72) Inventor: Stanley Mulfeld, Sunnyside, NY (US)

( * ) Notice: Subject to any disclaimer, the term of this patent is extended or adjusted under 35 U.S.C. 154(b) by 56 days.

(21) Appl. No.: 16/266,030

(22) Filed: Feb. 2, 2019

(65) Prior Publication Data

US 2020/0245728 A1 Aug. 6, 2020

(51) Int. Cl.
*A44B 11/06* (2006.01)
*A44B 11/00* (2006.01)

(52) U.S. Cl.
CPC ..... *A44B 11/06* (2013.01); *A44B 11/006* (2013.01)

(58) Field of Classification Search
CPC ... Y10T 24/4002; A44B 11/06; A44B 11/006; A41F 1/008
See application file for complete search history.

(56) References Cited

U.S. PATENT DOCUMENTS 133,904 A * 12/1872 Walker ..... A44B 11/006 24/164
4,733,440 A * 3/1988 Ogawa ..... A44B 11/06 24/170
5,579,563 A 12/1996 Sim
6,898,826 B2 5/2005 Draper et al.
8,683,665 B2 * 4/2014 Fraze ..... A43C 11/146 24/593.11
9,149,090 B1 10/2015 Taylor
9,277,776 B2 3/2016 Laatz
9,351,526 B1 5/2016 Taylor
9,370,223 B1 6/2016 Taylor
9,918,522 B2 3/2018 Laatz

* cited by examiner

*Primary Examiner* — Robert Sandy
*Assistant Examiner* — Louis A Mercado
(74) *Attorney, Agent, or Firm* — Merek, Blackmon & Voorhees, LLC

(57) ABSTRACT

A buckle operable with a securement strap. In a most preferred form, the buckle is a belt buckle for a belt including a belt strap having a free end, a connection end and an inner surface having one or more belt strap abutment portions. The buckle includes a body having a first end, a second end and a surface disposed between the first and second ends. The body further includes at least one buckle abutment portion extending outwardly or inwardly from the surface. The first end of the body is configured to be connected to a connection end of a belt strap. The at least one buckle abutment portion is configured to engage (i.e., to contact directly or be positioned to act with) at least one belt strap abutment portion. A release can be movably connected to the body. The moveable release (if used) can slide, pivot or otherwise move relative to the at least one buckle abutment portion.

20 Claims, 13 Drawing Sheets

FIG. 24
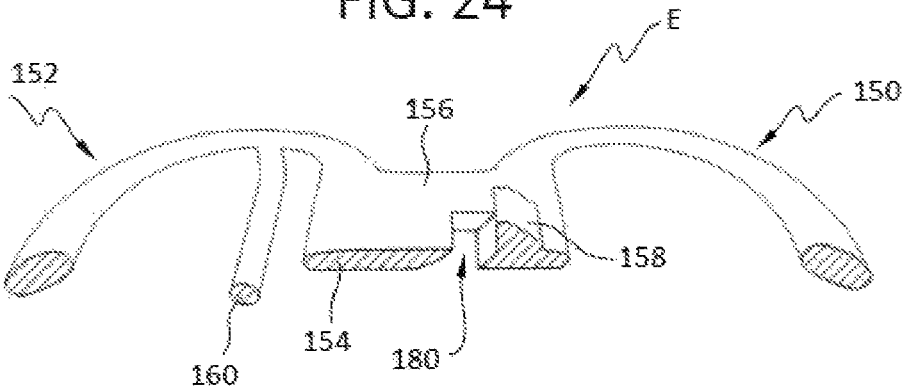
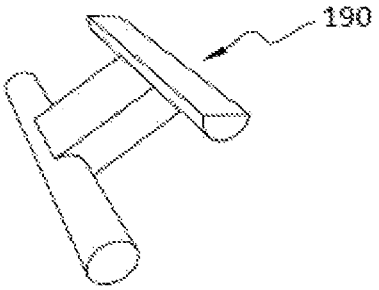
FIG. 25
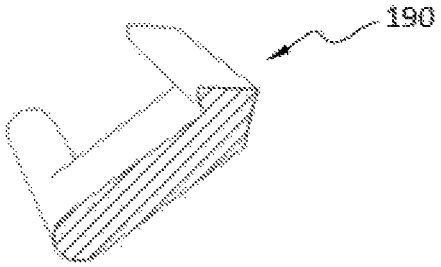
FIG. 26

BUCKLE FOR USE WITH A BELT, STRAP OR OTHER SECUREMENT MEMBER

FIELD OF THE INVENTION

The present invention is directed to a buckle for use with a securement belt, strap or other member. Some preferred forms of the present invention are directed to belt buckles and belts that are worn by a person having a belt strap and a belt buckle. Other preferred forms of the present invention are directed to buckles used with other types of securement straps/members including securement straps/members attached to carrying devices (e.g., backpacks, laptop/computer bags, gym bags, etc.)

BACKGROUND OF THE INVENTION

Numerous belt buckles have relied upon a well-known prong pivotally mounted on a buckle to penetrate a desired one of a plurality of holes or openings formed in a belt strap to secure the belt strap at a desired position relative to the belt buckle so that an item of clothing (e.g., pants, shorts, skirts, etc.) worn by an individual is maintained at a desired position on the body of the individual.

Buckles and belt straps have also been developed that eliminate the need for the well-known prong pivotally mounted on a buckle that penetrates a desired one of a plurality of holes or openings formed in a belt strap to secure the belt strap at a desired position relative to the belt buckle. U.S. Pat. Nos. 9,149,090; 9,351,526; and, 9,918,522 disclose belts that do not use the well-known prong pivotally mounted on a buckle to penetrate a desired one of a plurality of holes or openings formed in a belt strap to secure the belt strap at a desired position relative to the belt buckle. The belts of U.S. Pat. Nos. 9,149,090; 9,351,526; and, 9,918,522 require complex belt buckles that require a significant portion of the buckle itself to pivot to allow an individual to loosen the belt strap. These buckles also require a portion of the buckle that engages one or more teeth or protrusions formed on the inner surface of the belt strap to move with the release mechanism to allow an individual to loosen the belt strap.

OBJECTS AND SUMMARY OF THE INVENTION

An object of a preferred form of the present invention is to provide a novel and unobvious belt buckle.

Another object of a preferred form of the present invention is to provide a belt buckle that eliminates the need for the well-known prong pivotally mounted on a buckle that penetrates a desired one of a plurality of holes or openings formed in a belt strap to secure the belt strap at a desired position relative to the belt buckle and does not require a major portion of the belt buckle to pivot to allow an individual to loosen the buckle.

A further object of a preferred form of the present invention is to provide a belt buckle that eliminates the need for the well-known prong pivotally mounted on a buckle that penetrates a desired one of a plurality of holes or openings formed in a belt strap to secure the belt strap at a desired position relative to the belt buckle and that is easy to manufacture, use and/or manipulate.

Yet a further object of a preferred form of the present invention is to provide a belt buckle that eliminates the need for the well-known prong pivotally mounted on a buckle that penetrates a desired one of a plurality of holes or openings formed in a belt strap to secure the belt strap at a desired position relative to the belt buckle and that includes a release mechanism that is detachably connected to the body of the belt buckle.

Still another object of a preferred form of the present invention is to provide a belt buckle that eliminates the need for the well-known prong pivotally mounted on a buckle that penetrates a desired one of a plurality of holes or openings formed in a belt strap to secure the belt strap at a desired position relative to the belt buckle and includes a release mechanism slidably connected to and/or mounted about the body of the belt buckle.

Yet another object of a preferred form of the present invention is to provide a belt buckle that eliminates the need for the well-known prong pivotally mounted on a buckle that penetrates a desired one of a plurality of holes or openings formed in a belt strap to secure the belt strap at a desired position relative to the belt buckle and includes a release mechanism that moves relative to one or more abutment portions of the belt buckle that engage one or more abutment portions of the belt strap to allow an individual to loosen the belt strap.

Still yet another object of a preferred form of the present invention is to provide a belt buckle that eliminates the need for the well-known prong pivotally mounted on a buckle that penetrates a desired one of a plurality of holes or openings formed in a belt strap to secure the belt strap at a desired position relative to the belt buckle and is configured to allow an individual to loosen the belt strap using one or more fingers, i.e., the buckle is free of any release mechanism that must be activated to allow an individual to loosen the belt strap.

A further object of a preferred form of the present invention is to provide a buckle that can be used with numerous other types of securement members including buckles used with one or more securement straps/members attached to carrying devices (e.g., backpacks, laptop/computer bags, gym bags, etc.)

It must be understood that no one embodiment of the present invention need include all of the aforementioned objects of the present invention. Rather, a given embodiment may include one or none of the aforementioned objects of the preferred forms of the invention. Accordingly, these objects are not to be used to limit the scope of the claims of the present invention. Further, the above is not an exhaustive list of the advantages and objects of the preferred forms of the present invention. Other advantages and objects of preferred forms of the present invention will be readily appreciated from the description of the preferred forms of the present invention.

In summary, one preferred embodiment of the present invention is directed to a belt buckle for an adjustable belt including a belt strap having a free end, a connection end and an inner surface having one or more belt strap abutment portions. The buckle includes a body having a first end, a second end and a surface being disposed between the first end and the second. The body further including at least one buckle abutment portion extending outwardly or inwardly from the surface of the body. The first end of the body is configured to be connected to a connection end of a belt strap when a belt having the belt buckle and the belt strap is assembled. The at least one buckle abutment portion is configured to engage (e.g., to contact directly or being otherwise positioned to act with) at least one belt strap abutment portion when a belt having the belt buckle and the belt strap is worn by an individual to prevent the belt strap from being loosened. A moveable release is movably connected to the body of the buckle between an engagement position and a disengagement position. The moveable release can slide, pivot or otherwise move relative to the body. Preferably, the moveable release is configured to move relative to the at least one buckle abutment portion.

Another preferred embodiment of the present invention is directed to a belt buckle for an adjustable belt including a belt strap having a free end, a connection end and an inner surface having a plurality of belt strap abutment portions. The belt buckle includes a body having a first end, a second end and a surface being disposed between the first end and the second of the body of the belt buckle. The body further includes at least one buckle abutment portion (e.g., protrusion or recess) extending from the surface of the body. The first end of the body is configured to be connected to the connection end of the belt strap when a belt having the belt buckle and the belt strap is assembled. The at least one buckle abutment portion is configured to engage at least one of the plurality of belt strap abutment portions when a belt having the belt buckle and the belt strap is worn by an individual to prevent the belt strap from being loosened. The belt strap is preferably free of holes used to maintain the free end of the belt strap in a desired position relative to the belt buckle and the at least one buckle abutment portion preferably does not penetrate an outer surface of the belt strap. A moveable release is movably connected to the belt buckle. The moveable release is moveable relative to the at least one buckle abutment portion between a first position and a second position. The moveable release is configured such that when the moveable release is moved from the first position to the second position, the at least one of the plurality of belt strap abutment portions is disengaged from the at least one buckle abutment portion to allow an individual to loosen the belt strap.

A further embodiment of the present invention is directed to an apparatus comprising an adjustable securement strap having a plurality of securement strap abutment portions and a buckle including a body having a first end, a second end and a surface disposed between the first end and the second end of the body of the buckle. The body further includes at least one buckle abutment portion extending from the surface of the body. The at least one buckle abutment portion is configured to engage at least one of the plurality of securement strap abutment portions to prevent the securement strap from being loosened. The at least one buckle abutment portion is fixed to the body such that the at least one buckle abutment portion does not move relative to the body.

Yet a further embodiment of the present invention is directed to a belt buckle including a body having a first end, a second end and a surface being disposed between the first end and the second of the body of the belt buckle. The body further includes at least one buckle abutment portion extending from the surface of the body. The first end of the body is configured to be connected to a connection end of a belt strap. The at least one buckle abutment portion is configured to engage at least one of a plurality of belt strap abutment portions formed on an interior of a belt strap when a belt having the belt buckle and belt strap is worn by an individual to prevent the belt strap from being loosened. The at least one buckle abutment portion is preferably fixed to the body such that the at least one buckle abutment portion does not move relative to the body. Preferably, the belt buckle is preferably free of any release mechanism that must be manipulated by an individual to loosen the belt strap.

Still a further embodiment of the present invention is directed to a belt buckle for an adjustable belt including a belt strap having a free end, a connection end and an inner surface having a plurality of belt strap abutment portions. The belt buckle includes a body having a first end, a second end and a surface disposed between the first end and the second end of the body of the belt buckle. The body further includes at least one buckle abutment portion extending from the surface (e.g., inwardly or outwardly) of the body. The first end of the body is configured to be connected to a connection end of a belt strap when a belt having the belt buckle and the belt strap is assembled. The at least one buckle abutment portion is configured to engage at least one of the plurality of belt strap abutment portions when a belt having the belt buckle and the belt strap is worn by an individual to prevent the belt strap from being loosened. A sliding moveable release is slidably connected to the body of the belt buckle. The sliding moveable release is slidable on the body of the belt buckle between a first position and a second position. The sliding moveable release is configured such that when the sliding moveable release is moved from the first position to the second position the at least one of the plurality of belt strap abutment portions is disengaged from the at least one buckle abutment portion to allow an individual to loosen the belt strap.

The above summary describes preferred forms of the present invention and is not in any way to be construed as limiting the claimed invention to the preferred forms.

BRIEF DESCRIPTION OF THE DRAWINGS

FIG. 24 is a perspective sectional view taken along a longitudinal axis of the belt buckle depicted in 23.

FIG. 25 is a perspective view of the moveable release depicted in FIG. 22.

FIG. 26 is a perspective sectional view of the moveable release depicted in FIGS. 22 and 25.

DETAILED DESCRIPTION OF THE PREFERRED EMBODIMENTS OF THE INVENTION

Figure 1:
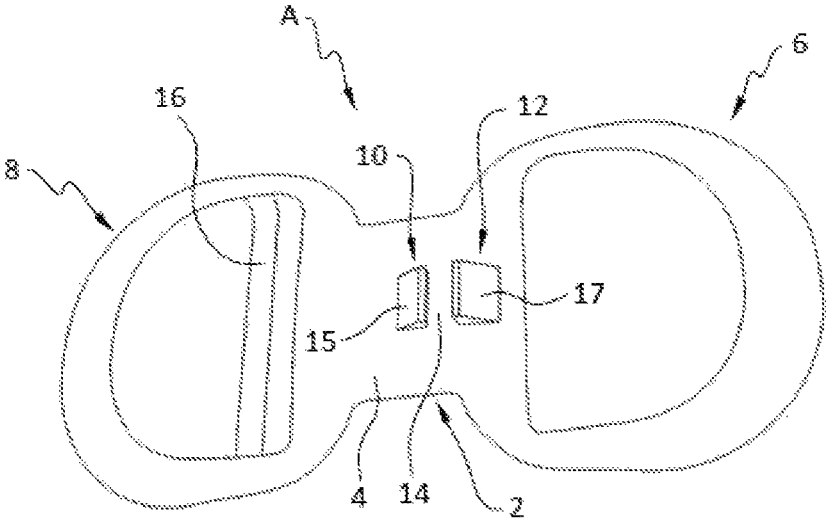
FIG. 1 is a perspective view of a belt buckle formed in accordance with one preferred embodiment of the present invention.
Figure 2:
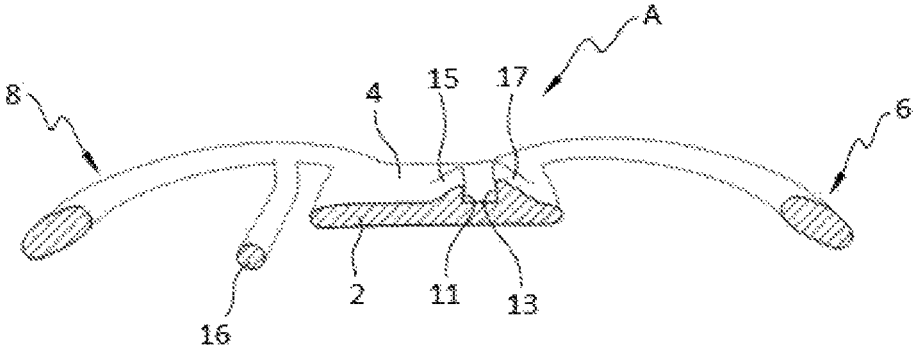
FIG. 2 is a sectional view taken along a longitudinal axis of the belt buckle depicted in 1.

The preferred forms of the invention are described below with reference to FIGS. 1-29. The appended claims are not limited to the preferred forms and no term and/or phrase used herein is to be given a meaning other than its ordinary meaning unless it is expressly stated otherwise. The terms "engage," "engaged," and "engaging" when used in connection with the relationship between one or more of the buckle abutment portions and one or more of the belt strap abutment portions means either direct contact or relative positioning (e.g., no direct contact) that when a belt having the belt buckle and the belt strap is worn by an individual prevents the belt strap from being loosened.

Belt buckles of the preferred forms of the present invention do not require the well-known prong pivotally mounted on a buckle to penetrate a desired one of a plurality of holes or openings formed in a belt strap to secure the belt strap at a desired position relative to the belt buckle. However, if desired, the present invention can be used with a belt strap having a plurality of non-functional holes or openings formed in a belt strap to simulate a well-known belt strap. Further, it is to be noted that "belt strap" or "strap" used herein includes any known or subsequently developed structure that is worn about an individual's body and operates or functions with a belt buckle. The strap can be formed from any material and can have many different cross-sectional shapes. The strap further can be formed as a single piece or from a plurality of pieces that are attached in any suitable manner. Also, the belt buckles of the present invention are not limited to the manner of attachment of the connection end of the belt strap (i.e., the end opposite the free end of the belt) to the belt buckle. Specifically, the claimed invention is not limited to the connector disclosed in FIGS. 6, 7 and 9. Rather, any suitable means can be used to connect the connection end of the belt strap to the buckle including but not limited to the connectors disclosed in U.S. Pat. Nos. 9,149,090; 9,351,526; and, 9,918,522. Similarly, the claimed invention is not limited to the belt strap depicted in FIGS. 6 and 8. Rather, any suitably configured belt strap may be used. Further, the belt buckle and belt strap can be formed from any suitable material including but not limited to metal, plastic, woven fabric, nylon, etc.

While some preferred forms of the present invention are directed to buckles used with a belt strap to hold items of clothing about an individual in a desired position, the buckles disclosed herein can be used in numerous other manners and environments including but not limited to buckles for back packs, car seats, seat belts, etc. where one or more buckles are used with one or more securement members to detachably secure a free end of one or more securement members to the one or more buckles.

FIGS. 1 Through 11

Referring to FIGS. 1 to 11, a belt buckle A formed in accordance with one preferred embodiment of present invention is illustrated in one of many possible configurations. The belt buckle A can take many forms including but not limited to the forms disclosed herein.

Belt buckle A, in one most preferred form, includes a body 2 having a surface 4 disposed and extending between a first end 6 and a second end 8. Abutment portions 10 and 12 extend outwardly from surface 4 and form a recess or cavity 14 therebetween. However, it should be noted that one or more abutment portions of the buckle A could extend inwardly from surface 4 (e.g., depressions, recesses, indentations, etc.). Preferably, abutment portion 12 extends outwardly from surface 4 a distance greater than abutment portion 10. The opposing inner surfaces 11 and 13 of abutment portions 10 and 12, respectively, preferably extend vertically or substantially vertically. The outer surfaces 15 and 17 of abutment portions 10 and 12, respectively, preferably are inclined and form an acute angle with corresponding inner surface of abutment portions 10 and 12. While abutment portions 10 and 12 are shown as being formed as one piece with body 2, abutment portions 10 and 12 can be formed as separates pieces that are attached to body 2.

Figure 7:
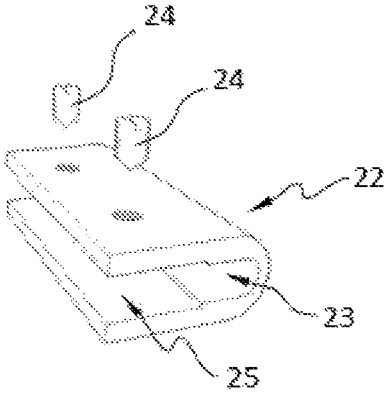
FIG. 7 is an exploded perspective view of one of many types of connectors that can be used to connect a connection end of a belt strap to a belt buckle formed in accordance with preferred forms of the present invention.

As seen in, for example FIGS. 1, 6, 7 and 9, buckle A includes a connector portion 16 for connecting a connection end 20 of a belt strap 21 to the buckle A using a connector 22. One or more fasteners 24 (e.g., screws, rivets, pins, etc.) can be employed to removably or permanently secure connector 22 to the connection end 20 of the belt strap 21. Referring to FIG. 7, connector 22 includes a U-shaped cavity 23 for receiving connector 16 of buckle A. Connector 22 further includes a cavity 25 for receiving a connection end of belt strap 21. Once connector 22 is mounted about member 16, fasteners 24 can be inserted into the corresponding holes of connector 22 to engage and/or penetrate a connection end of belt strap 21. This connection can allow belt strap 21 to pivot about member 16.

However, any suitable connector can be used to detachably connect or permanently fix the connection end of belt strap 21 to buckle A.

Figure 8:
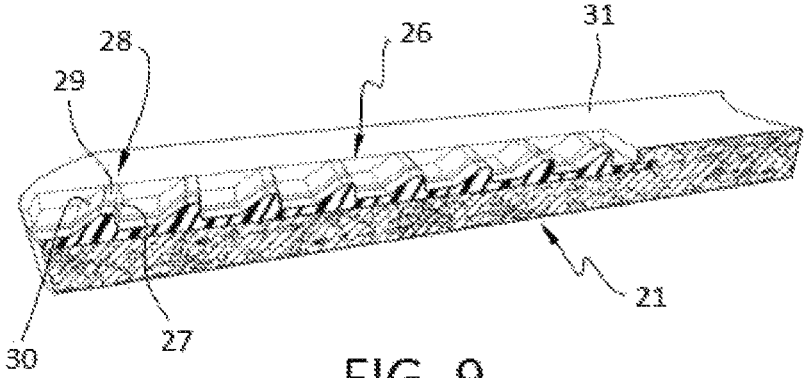
FIG. 8 is a perspective sectional view of a portion of the belt strap illustrated in FIG. 6.
Figure 9:
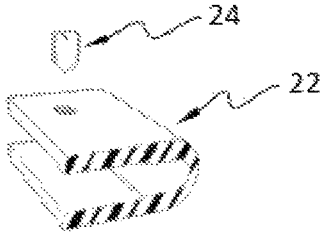
FIG. 9 is a sectional view of the connector depicted in FIGS. 6 and 7.

Referring to FIGS. 6, 8, 10 and 11, belt strap 21 includes a portion 26 having a plurality of belt strap abutment portions 28. Portion 26 can be formed in any suitable portion/section or segment of belt strap 21. Referring to FIG. 8, each abutment portions 28 preferably includes an inclined surface 30, a vertical or substantially vertical surface 27 and a horizontal or substantially horizontal surface 29 extending between surface 30 and surface 27. However, abutment portions 28 can take any suitable configuration including but not limited to openings, recess and/or indentations that extend partially in or completely through strap 21. In the most preferred form, surface 29 is aligned or substantially aligned with the inner surface 31 of strap 21.

Figure 10:
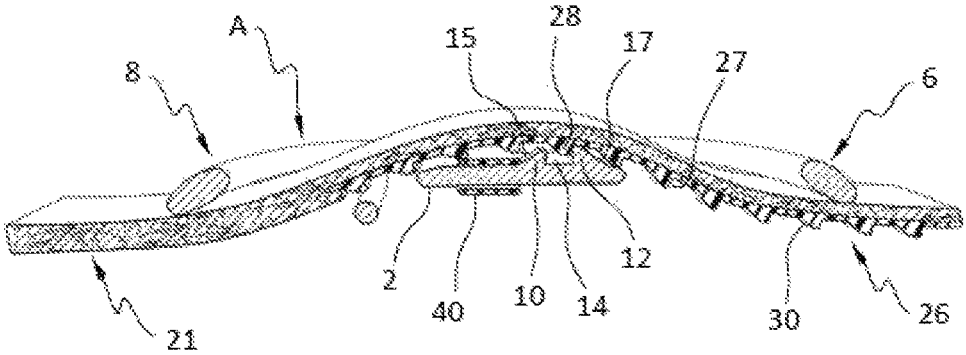
FIG. 10 is a sectional view of the belt buckle depicted in FIG. 1 with a portion of a preferred belt strap connected to the belt buckle with the moveable release in a first/non-activating position where the belt strap cannot be loosened.

As seen, in for example FIG. 10, recess 14 formed between members 10 and 12 is configured to receive one of the belt strap abutment portions 28 to prevent belt strap 21 from being loosened. However, recess 14 could receive a plurality of belt strap abutment portions 28. While portion 26 is shown as an elastomeric material that is connected/embedded in belt strap 21, belt strap 21 and portion 26 can be formed in any suitable manner including as a single piece. The inclined surfaces 30 of each belt strap abutment portion 28 and inclined surface 17 of buckle abutment portion 12 allow the belt strap 21 to be tightened even when one or more of the belt strap abutment portions 28 are disposed in recess 14. As seen in FIG. 10, when the vertical face 27 of the corresponding belt strap abutment portion 28 is disposed in recess 14, the belt strap 21 cannot be loosened.

Figure 3:
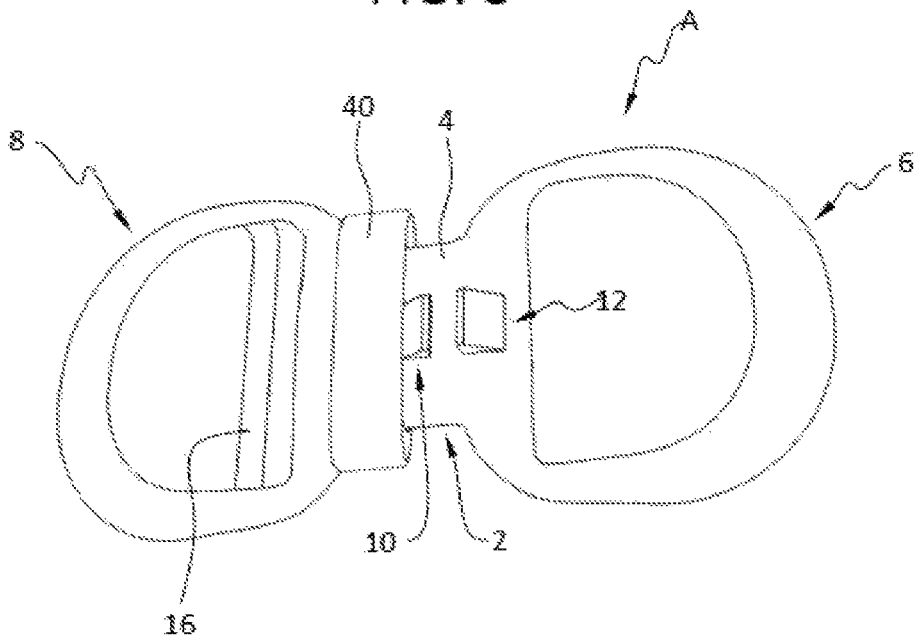
FIG. 3 is a perspective view of the embodiment illustrated in FIG. 1 with a preferred moveable release mounted about the body of belt buckle in a non-activating/first position preventing an inserted belt strap from being loosened.
Figure 11:
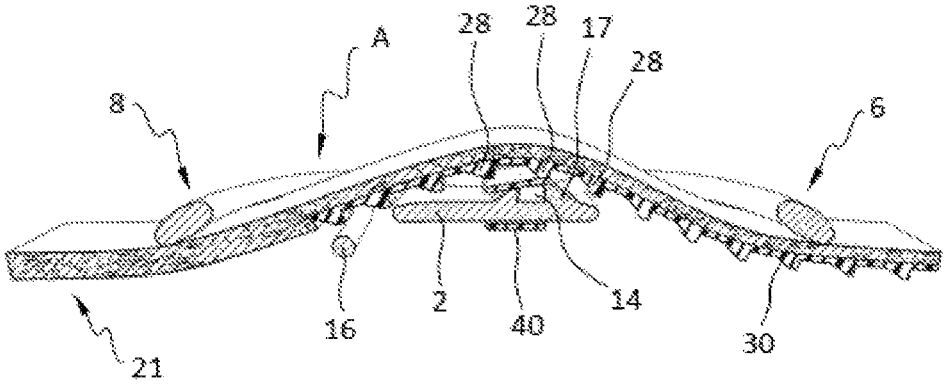
FIG. 11 is a sectional view of the belt buckle depicted in FIG. 1 with a portion of a preferred belt strap connected to the belt buckle with the moveable release in a second/activating position where the belt strap can be loosened.
Figure 14:
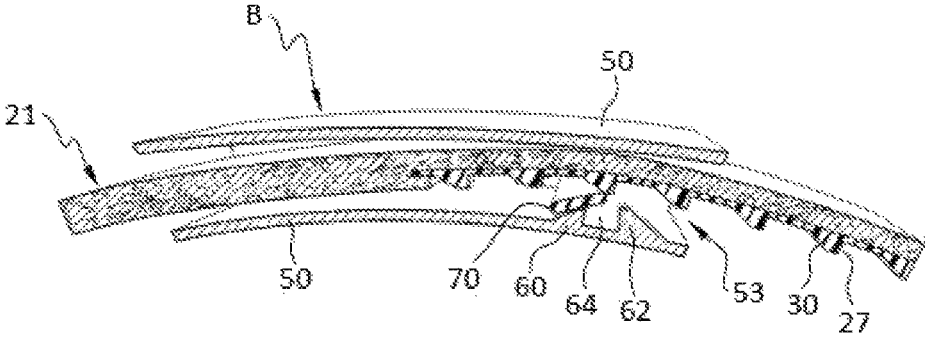
FIG. 14 is a sectional view of a portion of the belt buckle depicted in FIG. 12 with a portion of a preferred belt strap connected to the belt buckle with the moveable release in a second/activating position where the belt strap can be loosened.

Referring to, for example, FIGS. 3, 10 and 11, a moveable release 40 is moveably mounted about body 2 of buckle A. As seen in FIGS. 10 and 11, moveable release 40 moves/slides relative to portions 10 and 12 of body 2 between a first/non-activating position (FIG. 10) and a second/activating position (FIG. 11). When belt strap 21 is inserted through open ends 6 and 8 and secured to buckle A to prevent belt strap 21 from being loosened, release member 40 is in the first position depicted in FIGS. 3 and 10. To allow belt strap 21 to be loosened, an individual slides moveable release 40 to the right of the position depicted in FIGS. 3 and 10 to ride up and on or be closer to buckle abutment portion 10 to disengage the corresponding abutment portion of strap 21 from the abutment portions of buckle A to allow strap 21 to be loosened as shown in FIG. 11. As seen in FIG. 11, release member 40 in the second position completely block recess 14. However, release member need not completely or partially block recess 14 to disengage the corresponding abutment portions of belt strap 21 and buckle A. An example of partial blocking is depicted in FIG. 14.

Figure 4:
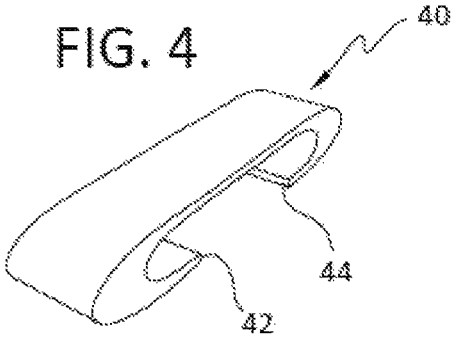
FIG. 4 is a perspective view of the preferred moveable release depicted in FIG. 3.
Figure 5:
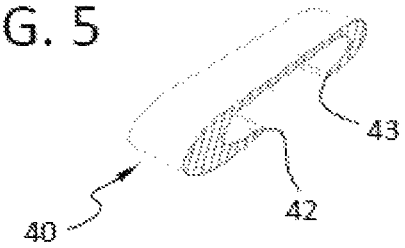
FIG. 5 is a cross-sectional view of the preferred moveable release depicted in FIGS. 3 and 4.
Figure 6:
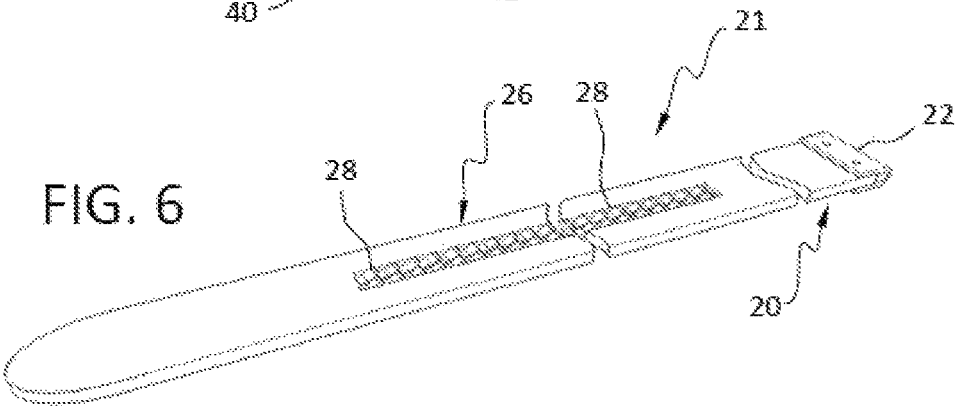
FIG. 6 is a perspective view of one of many belt straps that can be used with a belt buckle formed in accordance with preferred forms of the present invention.

In its most preferred form, moveable release 40 is a flexible member having a first end 42 spaced from a second end 44 as seen in FIGS. 4 and 5. This configuration allows moveable release 40 to be detachably connected to body 2 of the belt buckle A. However, it is to be understood that moveable release 40 can be fixed about body 2 where the moveable release 40 cannot be removed from the body 2 but can move relative to body 2. For example, moveable release 40 could be a closed ring or other closed structure mounted about body 2 of the belt buckle A.

Moveable release 40 can be omitted so that the buckle A has no release mechanism. Where the moveable release 40 is absent, an individual can manipulate (e.g., raise) a corresponding portion of belt strap 21 to free or remove the corresponding belt strap abutment portion from recess 14 to allow strap 21 to be loosened.

As seen in FIGS. 10 and 11, the free end of the belt strap 21 is inserted upwardly through end 6 and downwardly through end 8.

FIGS. 12 Through 15

Referring to FIGS. 12 to 15, a belt buckle B formed in accordance with one preferred embodiment of present invention is illustrated in one of many possible configurations. The belt buckle B can take many forms including but not limited to the forms disclosed herein.

Figure 13:
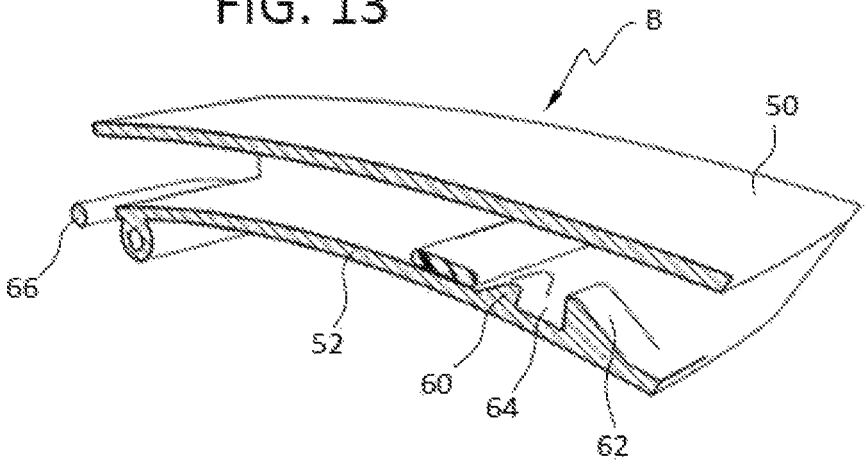
FIG. 13 is a sectional perspective view taken along a longitudinal axis of the belt buckle depicted in 12.
Figure 15:
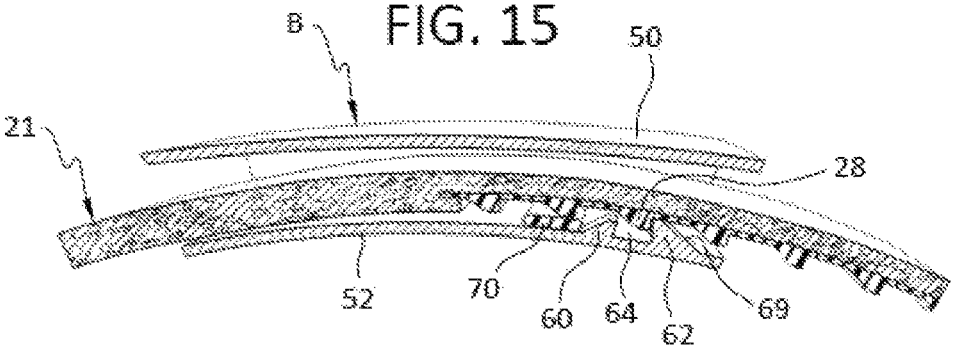
FIG. 15 is a sectional view of a portion of the belt buckle depicted in FIG. 12 with a portion of a preferred belt strap connected to the belt buckle with the moveable release in a first/non-activating position where the belt strap cannot be loosened.

Belt buckle B, in one most preferred form, includes an upper surface or wall 50, a lower surface or wall 52 and opposing side walls 54 and 56 extending between and connecting upper surface 50 to lower surface 52 forming an opening 53 extending completely through buckle B. Referring to FIGS. 13 to 15, abutment portions 60 and 62 extend outwardly from lower surface 52 and form a recess 64 therebetween. However, it should be noted that one or more abutment portions of the buckle B could extend inwardly from surface 52 (e.g., depressions, recesses, indentations, holes, etc.). Preferably, abutment portion 62 extends outwardly from surface 52 a distance greater than abutment portion 60. While abutment portions 60 and 62 are shown as being formed as one piece with lower surface 52, abutment portions 60 and 62 can be formed as separates pieces that are attached to surface 52. Abutment portions 60 and 62 can be formed in the same or similar manner as abutment portions 10 and 12.

Figure 12:
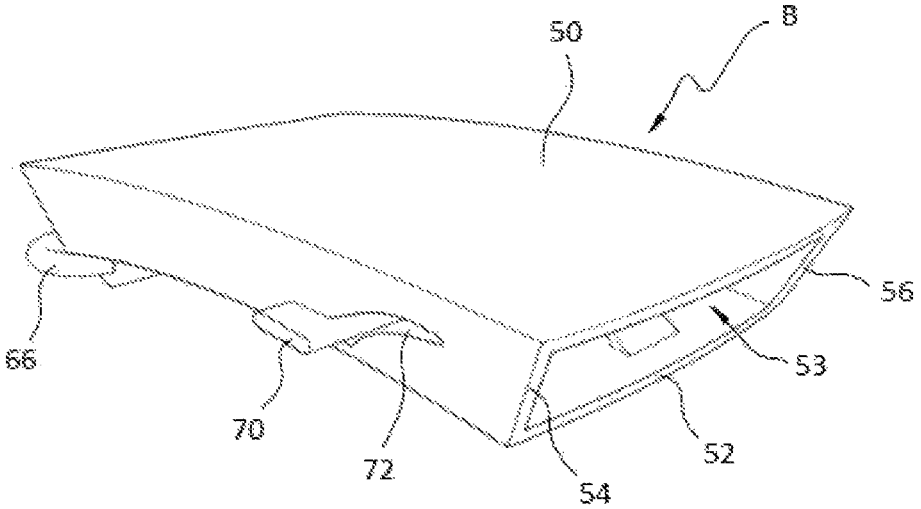
FIG. 12 is a perspective view of a belt buckle formed in accordance with another preferred embodiment of the present invention.

As seen in, for example FIGS. 12 and 13, buckle B includes a connector portion 66 for connecting a connection end 20 of belt strap 21 to the buckle B using a connector 22 in a similar manner as previously described in connection with the first preferred embodiment depicted in FIGS. 1 to 11. One or more fasteners 24 can be employed to removably or permanently secure connector 22 to the connection end 20 of the belt strap 21. However, any suitable connector can be used to detachably connect or permanently connect or fix the connection end of belt strap 21 to buckle B.

As seen, in for example FIG. 15, recess 64 formed between abutment portions 60 and 62 is configured to receive one of the belt strap abutment portions 28 to prevent belt strap 21 from being loosened. However, recess 64 could receive a plurality of belt strap abutment portions 28. While portion 26 is shown as an elastomeric material that is connected/embedded in belt strap 21, belt strap 21 and portion 26 can be formed as a single piece. The inclined surfaces 30 of each of belt strap abutment portion 28 and the inclined surface 69 of abutment portions 62 allow the belt strap 21 to be tightened even when one of the belt strap abutment portions 28 is disposed in recess 64. As seen in FIG. 15, when the vertical face 27 of the corresponding belt strap abutment portion 28 is disposed in recess 64, the belt strap 21 cannot be loosened.

Referring to, for example, FIGS. 12 to 15, a moveable release 70 is moveably mounted between upper surface 50 and lower surface 52 of buckle B. Each opposing side wall can have an arcuate opening 72 through which outer/exposed portions of release 70 extend to allow an individual to readily activate release 70. A detent (e.g., a raised member/projection/rib) can be detachably connected to each exposed portion of release 70 to maintain release member 70 operably connected to buckle B while allowing release member 70 to move/slide in each opening 72. Openings 72 preferably are configured such that as release 70 moves to the right as seen in FIGS. 12 to 15, release 70 rides upwardly in arcuate shaped opening 72. As seen in FIGS. 14 and 15, moveable release 70 moves relative to abutment portions 60 and 62 between a first/non-activating position (FIG. 15) and a second/activating position (FIG. 14). When belt strap 21 is inserted through the space/opening 53 formed between the upper surface 50 and lower surface 52 of buckle B to prevent belt strap 21 from being loosened, release member 70 is in the position depicted in FIGS. 13 and 15 and one of the belt strap abutment portions 28 is positioned in recess 64. To allow belt strap 21 to be loosened, an individual slides moveable release member 70 to the right of the position depicted in FIGS. 12, 13 and 15 to ride up and on abutment portion 60 or be closer to abutment portion 60 to disengage/raise/remove strap abutment portion 28 from recess 64 of buckle B to allow strap 21 to be loosened as shown in FIG. 14.

Figure 16:
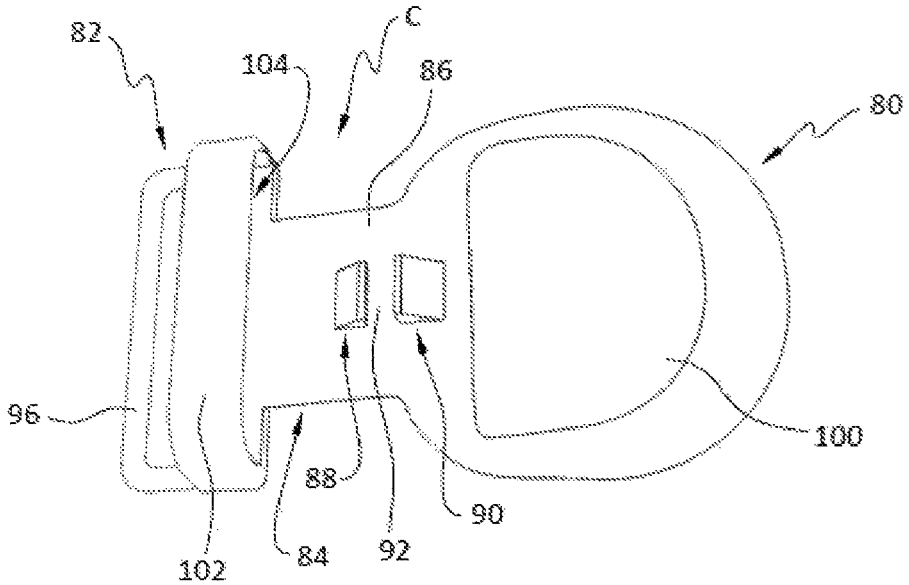
FIG. 16 is a perspective view of a belt buckle formed in accordance with another preferred embodiment of the present invention.
Figure 17:
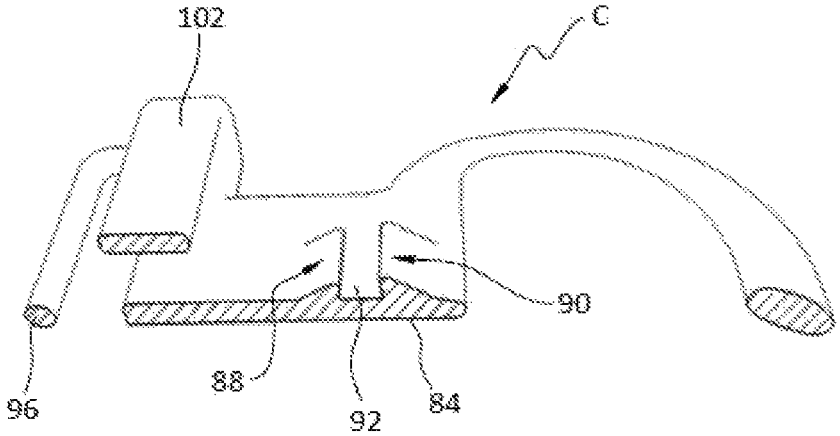
FIG. 17 is a sectional view taken along a longitudinal axis of the belt buckle depicted in 16.
Figure 18:
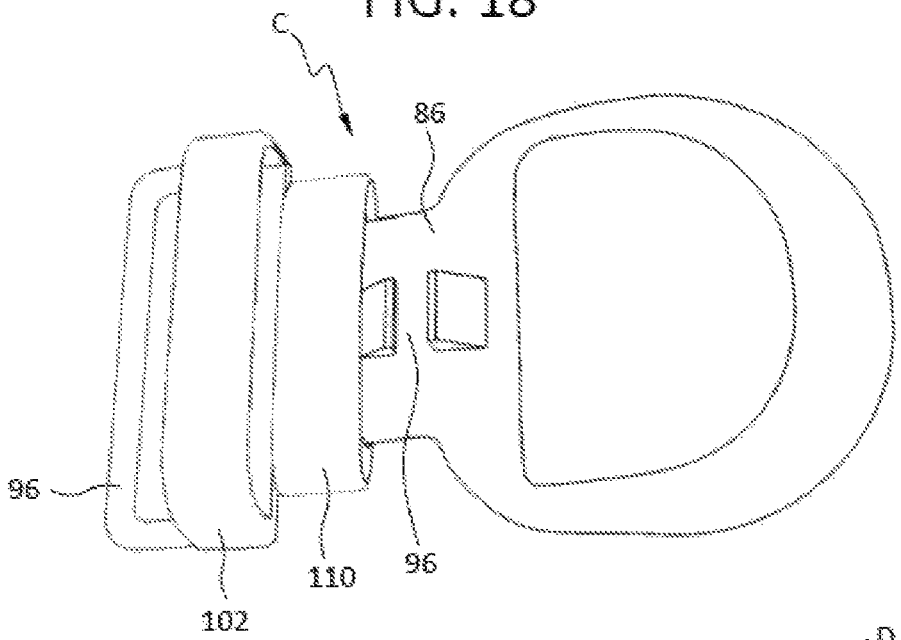
FIG. 18 is a perspective view of the embodiment illustrated in FIG. 16 with a preferred moveable release mounted about the body of belt buckle in a first/non-activating position where the belt strap cannot be loosened.

FIGS. 16 Through 18

Referring to FIGS. 16 to 18, a belt buckle C formed in accordance with another preferred embodiment of present invention is illustrated in one of many possible configurations. The belt buckle C can take many forms including but not limited to the form disclosed herein. Buckle C can be used with belt strap 21 or any other suitably formed belt strap.

Buckle C includes a first end 80, a second end 82, a body 84 having a surface 86 disposed and extending between the first end 80 and the second end 82. Buckle abutment portions 88 and 90 extend outwardly from surface 86 forming a recess 92 therebetween. Buckle abutment portions 88 and 90 can extend inwardly from surface 86 (e.g., depressions, recesses, indentations, etc.). As in the preferred embodiments of FIGS. 1 to 11 and 12 to 15, abutment portion 88 can extend outwardly from surface 86 a distance less than abutment portion 90.

Buckle C includes a connector portion 96 about which a connection end of a belt strap can be connected to buckle C by connector 22 and fasteners 24 or any other suitable connector. The first end 80 includes an opening 100 through which a free end of belt strap 21 is inserted upwardly through. Buckle C further includes a raised retaining member 102 extending outwardly from surface 86 and having an opening 104 for receiving and retaining a portion of the free end of the belt strap after the free end is inserted through opening 104. Referring to FIG. 18, buckle C preferably includes a moveable release 110. Moveable release 110 can take the form and function as the moveable release 40 described in connection with FIGS. 1 to 11.

Moveable release 110 can be omitted so that the buckle C has no release mechanism. Where the moveable release 110 is absent, an individual can manipulate a corresponding portion of the belt strap 21 to free or remove the corresponding belt strap abutment portion from recess 92.

Figure 19:
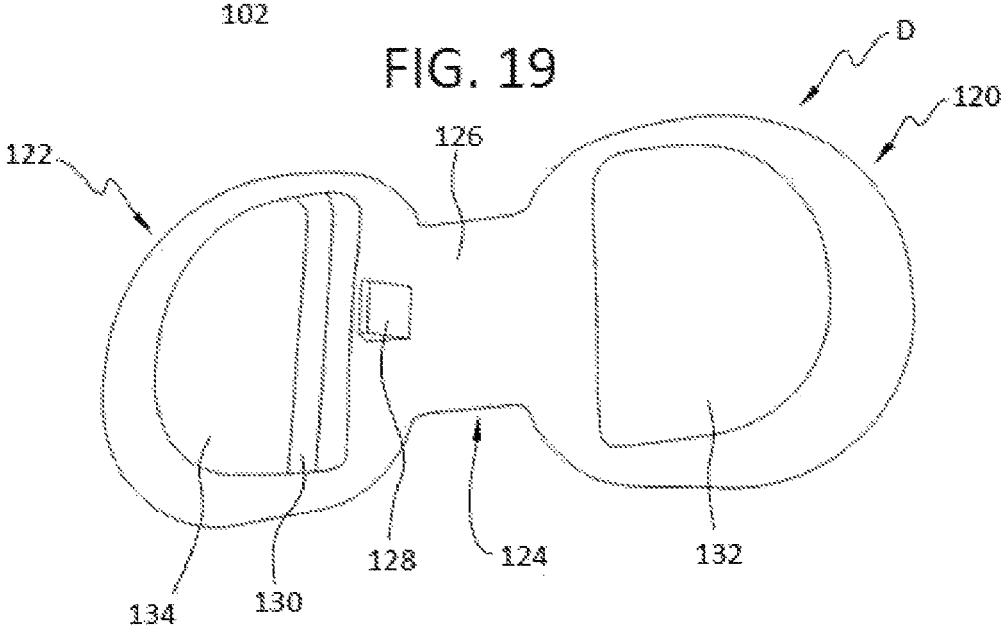
FIG. 19 is a perspective view of a belt buckle formed in accordance with another preferred embodiment of the present invention.
Figure 20:
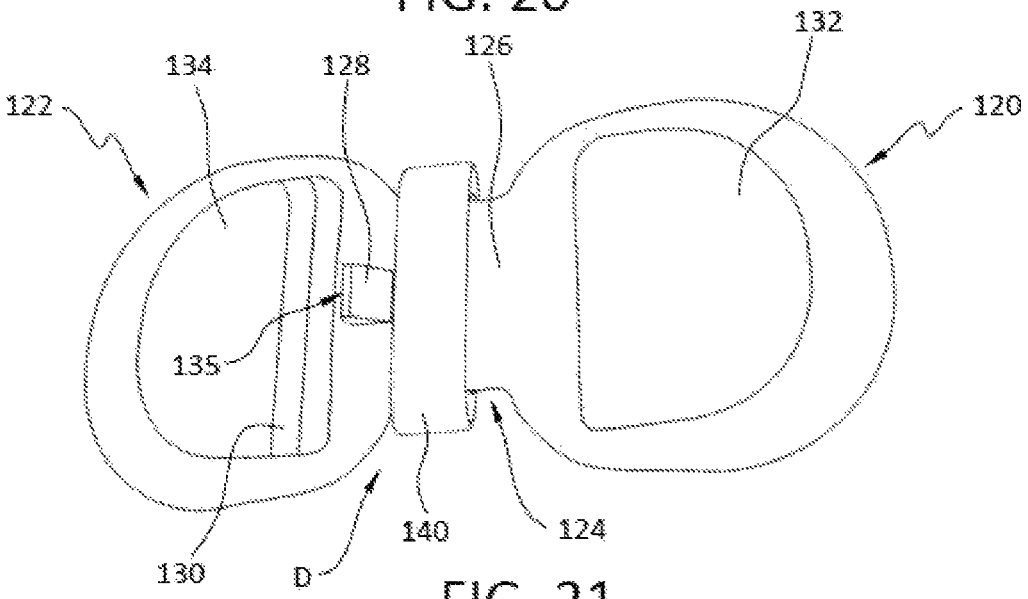
FIG. 20 is a perspective view of the embodiment illustrated in FIG. 19 with a preferred moveable release mounted about the body of belt buckle in a first/non-activating position where the belt strap cannot be loosened.
Figure 21:
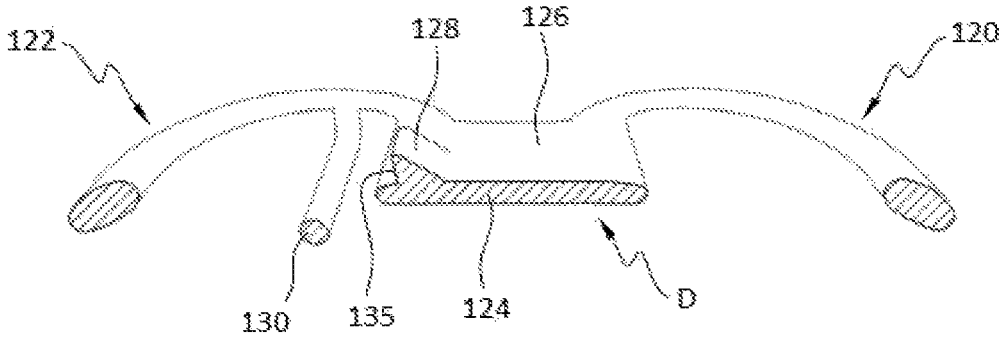
FIG. 21 is a sectional view taken along a longitudinal axis of the belt buckle depicted in 19.

FIGS. 19 Through 21

Referring to FIGS. 19 to 21, a belt buckle D formed in accordance with another preferred embodiment of present invention is illustrated in one of many possible configurations. The belt buckle D can take many forms including but not limited to the form disclosed herein. Buckle D can be used with belt strap 21 or any other suitably formed belt strap.

Buckle D includes a first end 120, a second end 122, a body 124 having a surface 126 extending between the first end 120 and the second end 122. Preferably, a buckle abutment portion 128 extends outwardly from surface 126. However, buckle abutment portion 128 can take any previously described form.

Buckle D includes a connector portion 130 about which a connection end of belt strap 21 can be connected to buckle D by connector 22 and fasteners 24 or any other suitable connector. The first end 120 includes an opening 132 through which a free end of a belt strap is inserted upwardly through. The second end 122 includes an opening 134 through which a free end of a belt strap is inserted downwardly through. Referring to FIG. 20, buckle D further includes a moveable release 140 slidably mounted on body 124. Upwardly extending face 135 of abutment portion 128 acts with the vertical face 27 of the corresponding belt strap abutment portion of belt strap 21 to prevent the belt strap 21 from being loosened when moveable release 140 is in the position shown in FIG. 20. When moveable release 140 as seen in FIG. 20 is moved to the left to ride up on abutment portion 128, the corresponding abutment portion of strap 21 is disengaged from abutment portion 128 of buckle D to allow the belt strap 21 to be loosened. In this embodiment, the free end of the belt strap is inserted upwardly through opening 132 and downwardly through opening 134. Moveable release 140 can take the form and function as the moveable release 40 described in connection with FIGS. 1 to 11.

Moveable release 140 can be omitted so that the buckle D has no release mechanism. Where the moveable release 140 is absent, an individual can manipulate a corresponding portion of the belt strap 21 to raise the corresponding belt strap abutment portion above buckle abutment portion 128 to allow the belt strap to be loosened.

FIGS. 22 Through 26

Referring to FIGS. 22 to 26, a belt buckle E formed in accordance with another preferred embodiment of present invention is illustrated in one of many possible configurations. The belt buckle E can take many forms including but not limited to the form disclosed herein. Buckle E can be used with belt strap 21 or any other suitably formed belt strap.

Buckle E includes a first end 150, a second end 152 and a body 154 having a surface 156 extending between the first end 150 and the second end 152. Preferably, a buckle abutment portion 158 extends outwardly from surface 156.

Figure 22:
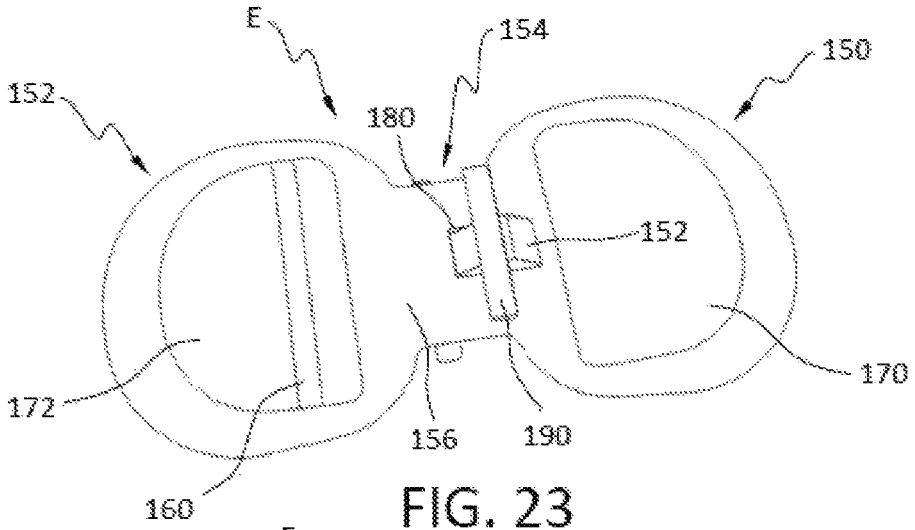
FIG. 22 is a perspective view of a belt buckle formed in accordance with another preferred embodiment of the present invention with another preferred form of moveable release movably connected to the belt buckle with the moveable release in a second/activating position allowing the belt strap to be loosened.
Figure 23:
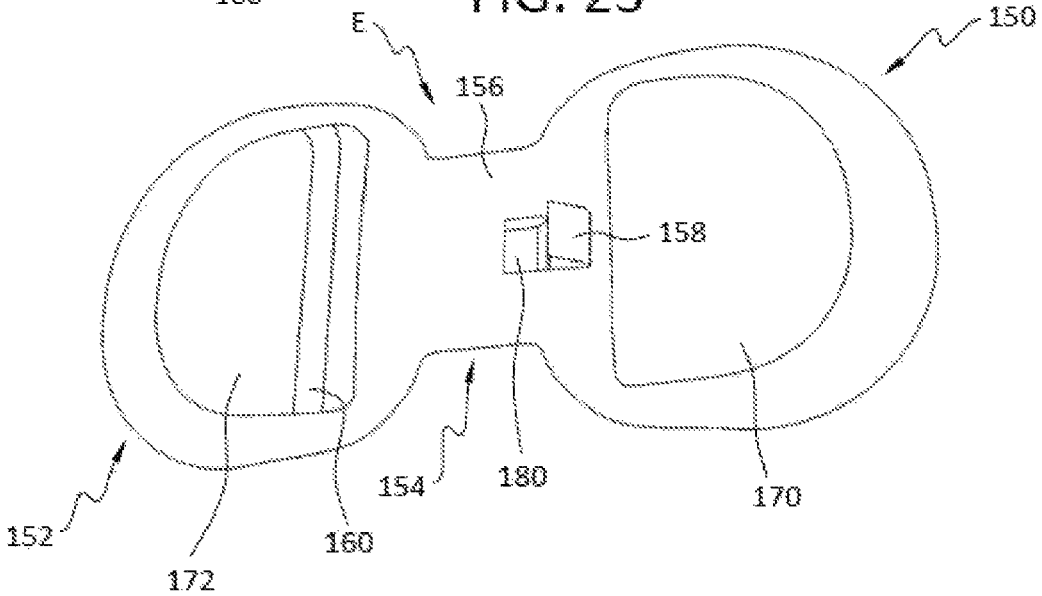
FIG. 23 is a perspective view of the belt buckle depicted in FIG. 22 without the moveable release.

Buckle E includes a connector portion 160 about which a connection end of a belt strap can be connected to buckle E by connector 22 and fasteners 24 or any other suitable connector. The first end 150 includes an opening 170 through which a free end of a belt strap is inserted upwardly through. The second end 152 includes an opening 172 through which a free end of a belt strap is inserted downwardly therethrough. Buckle E further includes an opening 180 extending through body 154. A moveable release 190 is movably/pivotally mounted in opening 180 of body 154. Abutment portion 158 acts with the vertical face 27 of the corresponding belt strap abutment portion of belt strap 21 to prevent the belt strap 21 from being loosened when moveable release 190 is moved to the left of the position depicted in FIG. 22 as this movement causes release 190 to move closer to surface 156 and away from belt strap 21. More specifically, when moveable release 190 is moved/pivoted to the left as seen in FIG. 22, the corresponding abutment portion of strap 21 is able to move downwardly to engage abutment portion 158 of buckle E to prevent the belt strap 21 from being loosened. Conversely, when moveable release 190 occupies the position shown in FIG. 22, the corresponding belt strap abutment portion of belt strap 21 is raised upwardly away from surface 156 to disengage the corresponding abutment portion of strap 21 from abutment portion 158 to allow belt strap 21 to be loosened. In this embodiment, the free end of the belt strap is inserted upwardly through opening 170 and downwardly through opening 172.

Moveable release 190 can be omitted so that the buckle E has no release mechanism. Where the moveable release 190 is absent, an individual can manipulate a corresponding portion of the belt strap 21 to raise the corresponding belt strap abutment portion above buckle abutment portion 158 to allow the belt strap to be loosened.

Figure 27:
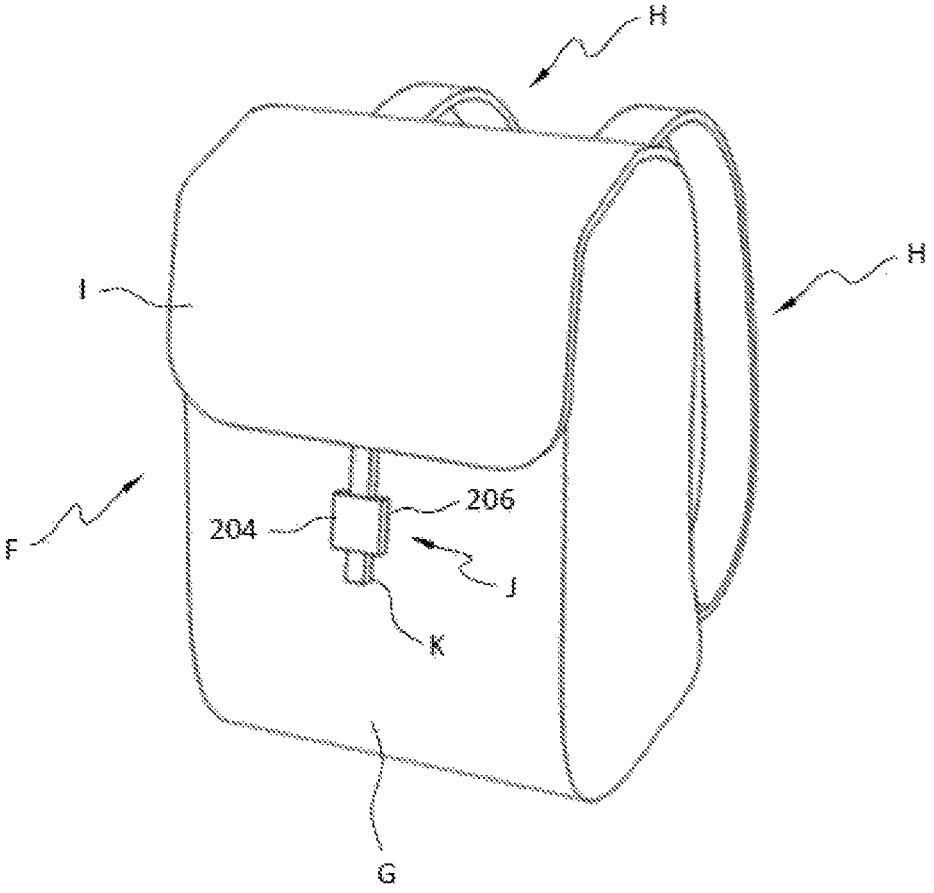
FIG. 27 is a perspective view of a backpack having a buckle and securement strap formed in accordance with another preferred embodiment of the present invention.
Figure 28:
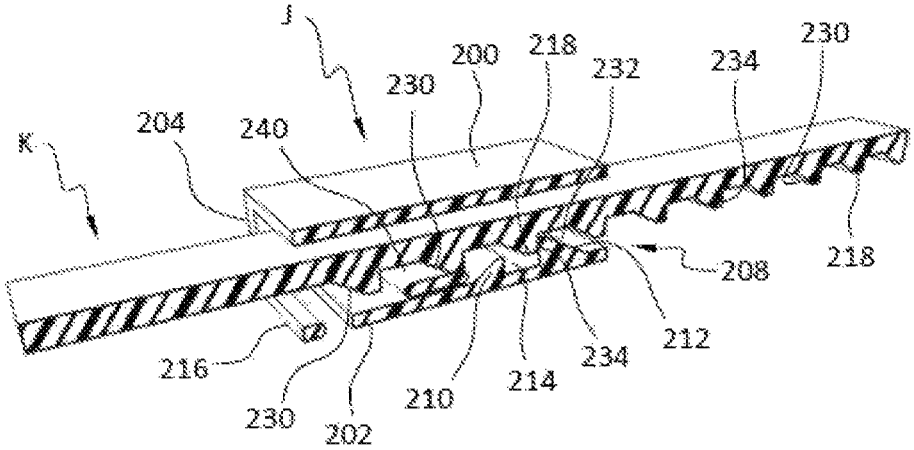
FIG. 28 is a perspective sectional view taken along a longitudinal axis of the buckle depicted in 27.

FIGS. 27 and 28

Referring to FIGS. 27 and 28, an article carrier F is illustrated in one of many possible configurations. While article carrier F is depicted as a backpack, it can take numerous other forms including but not limited to laptop/computer bags, gym bags, pursues, money pouches, etc. Article carrier F includes a body G for receiving and storing one or more articles/items to be carried, a pair of shoulder straps H, a closure flap I, a buckle J and securement member K. Buckle J can take the form of any of the previously described belt buckles or any other suitable form.

Referring to FIGS. 27 and 28, buckle J, in one most preferred form, includes an upper surface or wall 200, a lower surface or wall 202 and opposing side walls 204 and 206 extending between and connecting upper surface 200 to lower surface 202 forming an opening 208 extending completely through buckle J. Referring to FIG. 28, abutment portions 210 and 212 extend outwardly from lower surface 202 and form a recess 214 therebetween. However, it should be noted that one or more abutment portions of the buckle J could extend inwardly from surface 202 (e.g., depressions, recesses, indentations, holes, etc.). Preferably, right abutment portion 212 (as seen in FIG. 28) extends outwardly from surface 202 a distance greater than left abutment portion 210. While abutment portions 210 and 212 are shown as being formed as one piece with lower surface 202, abutment portions 210 and 212 can be formed as separates pieces that are attached to surface 202. Abutment portions 210 and 212 can be formed in the same or similar manner as abutment portions 10 and 12.

Buckle J may include a connector portion 216 for connecting an end of buckle J to body G of article carrier F. A strap or piece of fabric may be secured about connector portion 216 to allow an individual to move the buckle J relative to body G. It is to be noted that buckle J could be connected to closure flap I as opposed to body G.

As seen in FIG. 28, recess 214 formed between abutment portions 210 and 212 is configured to receive one of the securement strap abutment portions 218 to prevent the free end of securement member K from being detached from buckle J or pulled to the right as seen in FIG. 28 or pulled upwardly as seen in FIG. 27. However, recess 214 could receive a plurality of strap abutment portions 218. The inclined surfaces 230 of each of strap abutment portion 218 and the inclined surface 232 of abutment portions 212 allow strap K to be tightened even when one of the strap abutment portions 218 is disposed in recess 214. As seen in FIG. 28, when the vertical face 234 of the corresponding strap abutment portion 218 is disposed in recess 214, strap K cannot be detached from buckle J or pulled to the right as seen in FIG. 28 or pulled upwardly as seen in FIG. 27.

Referring to FIG. 28, a moveable release 240 is moveably mounted between upper surface 200 and lower surface 202 of buckle J. Moveable release 240 can be the same as or similar to release 70. Each opposing side wall 204 and can have an elongated opening similar to or the same as arcuate opening 72 through which outer/exposed portions of release 240 extend to allow an individual to readily activate release 240.

Release 240 moves relative to abutment portions 210 and 212 between a first/non-activating position (FIG. 28) and a second/activating position where all or a portion of moveable release 240 is on abutment portion 210 causing securement member K to move outwardly away from lower surface 202 which in turn raises the strap abutment portion or portions 218 out of recess 214 to allow securement member K to be detached from buckle J or pulled to the right as seen in FIG. 28 or pulled upwardly as seen in FIG. 27.

When strap K is inserted through the space/opening 208 formed between the upper surface 200 and lower surface 202 of buckle J to prevent strap K from being loosened, release member 240 is in the position depicted in FIG. 28 and at least one of the strap abutment portions 218 is positioned in recess 214. To allow strap K to be loosened, an individual slides moveable release member 240 to the right of the position depicted in FIG. 28 to ride up and on abutment portion 210 or be closer to abutment portion 210 to disengage/raise/remove strap abutment portion 218 from recess 214 of buckle J to allow strap K to be detached from buckle J or pulled to the right as seen in FIG. 28 or pulled upwardly as seen in FIG. 27.

FIG. 29

Figure 29:
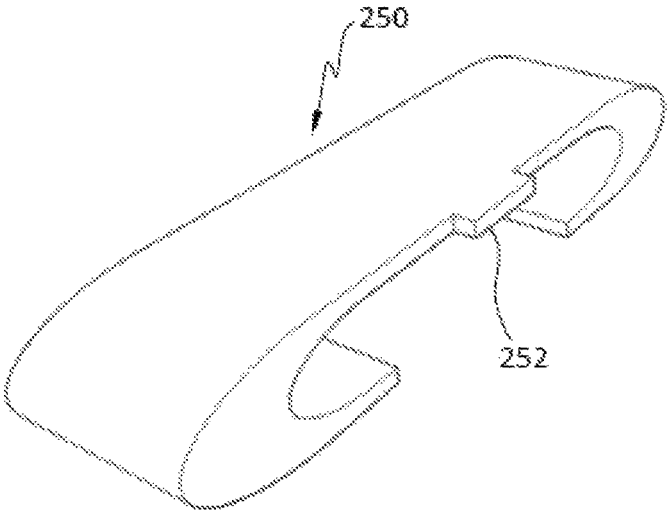
FIG. 29 is a perspective view of another preferred form of moveable release.

FIG. 29 illustrates a further form of moveable release that can be used with any suitable buckle. Specifically, moveable release 250 illustrated in FIG. 29 is similar to release 40 and, therefore, only the differences will be described in detail. Release 250 includes a forward projecting member 252 to assist in returning release 250 to the non-activating position. In the activating position, forward projecting member 252 is on a corresponding/adjacent buckle abutment portion so that projecting member 252 is inclined upwardly toward the securement strap providing a contact surface for a corresponding portion of the securement strap to engage when the securement strap is moved toward the non-activating position causing release member 250 to fully return to the non-activating position. However, release 250 could ride up on the adjacent buckle abutment portion a sufficient distance so that release 250 rests on an uppermost surface of the adjacent buckle abutment portion and member 252 extends parallel or substantially parallel to a portion of the buckle (e.g., wall 202).

While this invention has been described as having preferred designs, it is understood that the each and every preferred design can be further modified or adapted following in general the principles of the invention and including but not limited to such departures from the present invention as come within the known or customary practice in the art to which the invention pertains. The claims are not limited to the preferred embodiments and have been written to preclude such a narrow construction using the principles of claim differentiation.

I claim:

1. A belt buckle for an adjustable belt including a belt strap having a free end, a connection end and an inner surface having a plurality of belt strap abutment portions, said belt buckle comprising:

(a) a body having a first end, a second end and a surface being disposed between said first end and said second end of said body of said belt buckle, said body further including at least one buckle abutment portion extending from said surface of said body, said first end of said body being configured to be connected to the connection end of the belt strap when a belt having said belt buckle and the belt strap is assembled, said at least one buckle abutment portion being configured to engage at least one of the plurality of belt strap abutment portions when the belt having said belt buckle and the belt strap is worn by an individual to prevent the belt strap from being loosened, the belt strap being free of holes used to maintain the free end of the belt strap in a desired position relative to said belt buckle and said at least one buckle abutment portion does not penetrate an outer surface of the belt strap; and, (b) a moveable release movably connected to said belt buckle, said moveable release being moveable relative to said at least one buckle abutment portion between a first position and a second position, said moveable release being configured such that when said moveable release is moved from said first position to said second position said at least one of the plurality of belt strap abutment portions is disengaged from said at least one buckle abutment portion to allow the individual to loosen the belt strap wherein an outermost surface of said moveable release engages an inner surface of said belt strap when the moveable release is in said second position.

2. The belt buckle of claim 1, wherein:

(a) said moveable release is detachably connected to said body of said belt buckle.

3. The belt buckle of claim 1, wherein:

(a) said at least one buckle abutment portion extends outwardly from said surface of said body of said belt buckle.

4. The belt buckle of claim 1, wherein:

(a) said body includes first and second buckle abutment portions extending outwardly from said surface of said body of said belt buckle, said first buckle abutment portion being spaced from said second buckle abutment portion to form a recess to receive at least a segment of at least one of the plurality of belt strap abutment portions to maintain the free end of the belt strap in a desired position relative to said belt buckle.

5. The belt buckle of claim 1, wherein:

(a) said moveable release is configured to pivot relative to said at least one buckle abutment portion between said first position and said second position.

6. The belt buckle of claim 1, wherein:

(a) said second end of said body includes a closed loop configured to allow the free end of the belt strap to be inserted into said closed loop.

7. A belt buckle for an adjustable belt including a belt strap having a free end, a connection end and an inner surface having a plurality of belt strap abutment portions, said belt buckle comprising:

(a) a body having a first end, a second end and a surface being disposed between said first end and said second end of said body of said belt buckle, said body further including at least one buckle abutment portion extending from said surface of said body, said first end of said body being configured to be connected to the connection end of the belt strap when a belt having said belt buckle and the belt strap is assembled, said at least one buckle abutment portion being configured to engage at least one of the plurality of belt strap abutment portions when the belt having said belt buckle and the belt strap is worn by an individual to prevent the belt strap from being loosened, the belt strap being free of holes used to maintain the free end of the belt strap in a desired position relative to said belt buckle and said at least one buckle abutment portion does not penetrate an outer surface of the belt strap;

(b) a moveable release movably connected to said belt buckle, said moveable release being moveable relative to said at least one buckle abutment portion between a first position and a second position, said moveable release being configured such that when said moveable release is moved from said first position to said second position said at least one of the plurality of belt strap abutment portions is disengaged from said at least one buckle abutment portion to allow the individual to loosen the belt strap; and, (c) said moveable release is configured to slide on said body of said belt buckle between said first position and said second position.

8. The belt buckle of claim 7, wherein:

(a) said moveable release is configured such that said moveable release is positioned closer to said at least one buckle abutment portion when said moveable release is in said second position than when said moveable release is in said first position.

9. The belt buckle of claim 7, wherein:

(a) said moveable release is formed from a flexible material and includes a first free end and a second free end, said first free end is spaced from said second free end to allow said moveable release to be mounted about said body of said belt buckle.

10. An apparatus, comprising:

(a) an adjustable securement strap having a plurality of securement strap abutment portions;

(b) a buckle including a body having a first end, a second end and a surface being disposed between said first end and said second end of said body of said buckle, said body further including at least one buckle abutment portion extending from said surface of said body, said at least one buckle abutment portion being configured to engage at least one of the plurality of securement strap abutment portions to prevent the adjustable securement strap from being loosened, said at least one buckle abutment portion being fixed to said body such that said at least one buckle abutment portion does not move relative to said body wherein the adjustable securement strap is free of holes used to maintain a free end of the adjustable securement strap in a desired position relative to said buckle; and, (c) a moveable release movably connected to said buckle, said moveable release being moveable relative to said at least one buckle abutment portion between a first position and a second position, said moveable release being configured such that when said moveable release is moved from said first position to said second position said at least one of the plurality of securement strap abutment portions is disengaged from said at least one buckle abutment portion to allow an individual to loosen the adjustable securement strap.

11. The apparatus of claim 10, wherein:

(a) said moveable release is configured to slide on said body of said buckle between said first position and said second position.

12. The apparatus of claim 11, wherein:

(a) said moveable release is configured such that said moveable release is positioned closer to said at least one buckle abutment portion when said moveable release is in said second position than when said moveable release is in said first position.

13. The apparatus of claim 11, wherein:

(a) said moveable release is detachably connected to said body of said buckle.

14. The apparatus of claim 11, wherein:

(a) said moveable release is formed from a flexible material and includes a first free end and a second free end, said first free end is spaced from said second free end to allow said moveable release to be mounted about said body of said buckle.

15. A belt buckle for an adjustable belt including a belt strap having a free end, a connection end and a surface having a plurality of belt strap abutment portions, said belt buckle comprising:

(a) a body having a first end, a second end and a surface being disposed between said first end and said second end of said body of said belt buckle, said body further including at least one buckle abutment portion extending from said surface of said body, said first end of said body being configured to be connected to the connection end of the belt strap when a belt having said belt buckle and the belt strap is assembled, said at least one buckle abutment portion being configured to engage at least one of the plurality of belt strap abutment portions when the belt having said belt buckle and the belt strap is worn by an individual to prevent the belt strap from being loosened; and, (b) a sliding moveable release slidably connected to said body of said belt buckle, said sliding moveable release being slidable on said body of said belt buckle between a first position and a second position, said sliding moveable release being configured such that when said sliding moveable release is moved from said first position to said second position said at least one of the plurality of belt strap abutment portions is disengaged from said at least one buckle abutment portion to allow the individual to loosen the belt strap wherein an outermost surface of the sliding moveable release member engages an inner surface of the belt strap.

16. The belt buckle of claim 15, wherein:

(a) said sliding moveable release is configured such that said sliding moveable release is positioned closer to said at least one buckle abutment portion when said sliding moveable release is in said second position than when said sliding moveable release is in said first position.

17. The belt buckle of claim 15, wherein:

(a) said sliding moveable release is detachably connected to said body of said belt buckle.

18. The belt buckle of claim 15, wherein:

(a) said sliding moveable release is formed from a flexible material and includes a first free end and a second free end, said first free end is spaced from said second free end to allow said moveable release to be mounted about said body of said belt buckle.

19. The belt buckle of claim 15, wherein:

(a) said at least one buckle abutment portion extends outwardly from said surface of said body of said belt buckle.

20. The belt buckle of claim 15, wherein:

(a) said body includes first and second buckle abutment portions extending outwardly from said surface of said body of said belt buckle, said first buckle abutment portion is spaced from said second buckle abutment portion to form a recess to receive at least a segment of at least one of the plurality of belt strap abutment portions to maintain the free end of the belt strap in a desired position relative to said belt buckle, said first and second buckle abutment portions being fixed to said body such that said first and second buckle abutment portions do not move relative to said body of said belt buckle.

* * * * *